US009986613B2

(12) United States Patent
Clout et al.

(10) Patent No.: US 9,986,613 B2
(45) Date of Patent: May 29, 2018

(54) METHODS AND APPARATUS FOR CALIBRATING LIGHT OUTPUT BASED ON REFLECTED LIGHT

(71) Applicant: PHILIPS LIGHTING HOLDING B.V., Eindhoven (NL)

(72) Inventors: Ramon Antoine Wiro Clout, Eindhoven (NL); Bartel Marinus Van De Sluis, Eindhoven (NL); Philip Steven Newton, Waalre (NL); Tim Dekker, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days. days.

(21) Appl. No.: 15/122,280

(22) PCT Filed: Feb. 11, 2015

(86) PCT No.: PCT/IB2015/051005

§ 371 (c)(1),
(2) Date: Aug. 29, 2016

(87) PCT Pub. No.: WO2015/128763

PCT Pub. Date: Sep. 3, 2015

(65) Prior Publication Data

US 2016/0366744 A1 Dec. 15, 2016

Related U.S. Application Data

(60) Provisional application No. 61/946,243, filed on Feb. 28, 2014.

(51) Int. Cl.
*H05B 33/08* (2006.01)

(52) U.S. Cl.
CPC ..... *H05B 33/0854* (2013.01); *H05B 33/0851* (2013.01)

(58) Field of Classification Search
CPC ..... H05B 33/0851; H05B 33/0854; H05B 33/0869; H05B 33/0875; H05B 33/0881; H05B 33/0884

(Continued)

(56) References Cited

U.S. PATENT DOCUMENTS 8,159,156 B2 4/2012 Henig et al.
8,378,587 B2 2/2013 Huguenin et al.

(Continued)

FOREIGN PATENT DOCUMENTS

DE 102008036992 A1 2/2010
DE 102012006860 A1 10/2013

*Primary Examiner* — Jason M Crawford
(74) *Attorney, Agent, or Firm* — Meenakshy Chakravorty

(57) ABSTRACT

Disclosed are lighting devices (102), luminaires, lighting systems, lighting modules (104), and methods of controlling the same are taught herein. In various embodiments, a lighting device (102) may include a light source such as an LED (118) configured to emit light towards a targeted portion (106) of a surface (108). An LED driver (120) may be configured energize the LED in response to a compensated signal (132). A light sensor (122) may be configured to measure light reflected from the targeted portion of the surface and to generate a reflected light signal (128) that represents one or more properties of the reflected light. A controller (116) may be operably coupled with the LED driver and the light sensor. The controller may be configured to generate the compensated signal based on the reflected light signal and an input signal (130) that represents one or more desired properties of light to be reflected from the targeted portion of the surface.

8 Claims, 4 Drawing Sheets

(58) Field of Classification Search
USPC ..... 315/149–151, 155, 158
See application file for complete search history.

(56) References Cited

U.S. PATENT DOCUMENTS

| | | | | |
|---|---|---|---|---|
| 9,232,609 | B2 * | 1/2016 | Genthon | H05B 33/0845 |
| 2009/0189530 | A1 * | 7/2009 | Ashdown | H05B 33/0818 315/152 |
| 2010/0026187 | A1 * | 2/2010 | Kelly | A47F 11/10 315/113 |
| 2010/0148677 | A1 * | 6/2010 | Melanson | H05B 33/0869 315/154 |
| 2011/0031901 | A1 * | 2/2011 | Huguenin | H05B 33/0851 315/307 |
| 2013/0088155 | A1 * | 4/2013 | Maxik | H05B 33/0869 315/153 |

* cited by examiner

400

METHODS AND APPARATUS FOR CALIBRATING LIGHT OUTPUT BASED ON REFLECTED LIGHT

CROSS-REFERENCE TO PRIOR APPLICATIONS

This application is the U.S. National Phase application under 35 U.S.C. § 371 of International Application No. PCT/IB2015/051005, filed on Feb. 11, 2015, which claims the benefit of U.S. Patent Application No. 61/946,243, filed on Feb. 28, 2014. These applications are hereby incorporated by reference herein.

TECHNICAL FIELD

The present invention is directed generally to lighting control. More particularly, various inventive methods and apparatus disclosed herein relate to calibrating light output based on measured light reflected off a surface.

BACKGROUND

Digital lighting technologies, i.e., illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g., red, green, and blue, as well as a processor for independently controlling the output of the LEDs in order to generate a variety of colors and color-changing lighting effects.

Lighting devices, luminaires and/or lighting systems may include multiple light sources such as LEDs. When multiple light sources emit light towards a surface, light emitted by individual light sources may overlap with light emitted by others. This may result in the surface appearing unevenly illuminated, with some portions illuminated more brightly than others. Additionally, ambient light from other sources such as sunlight may affect how collective light emitted by a plurality of light sources is distributed on a surface.

Thus, there is a need in the art to facilitate even distribution of light emitted by a plurality of light sources.

SUMMARY

The present disclosure is directed to inventive methods and apparatus for calibrating light output of a light source based on light reflected off a surface. For example, a lighting device, lighting unit, luminaire and/or lighting system may include one or more lighting modules, each including a light source such as LEDs and a light sensor. The light source may be driven in a manner that compensates for light reflected off a surface that is sensed by the light sensor. This may facilitate, for instance, multiple lighting modules of a luminaire emitting collective light that appears relatively uniform on a surface.

Generally, in one aspect, the invention relates to a lighting device including an LED configured to emit light towards a targeted portion of a surface, an LED driver to energize the LED in response to a compensated signal, a light sensor configured to measure light reflected from the targeted portion of the surface and to generate a reflected light signal that represents one or more properties of the reflected light, and a controller operably coupled with the LED driver and the light sensor. The controller may be configured to generate the compensated signal based on the reflected light signal and an input signal that represents one or more desired properties of light to be reflected from the targeted portion of the surface.

In various embodiments, the LED and the light sensors are co-located. In various versions, the light sensor is positioned relative to the LED such that the light emitted by the LED and the light reflected from the targeted portion of the surface and measured by the light sensor having at least partially overlapping optical paths.

In various embodiments, the LED comprises a first LED, the LED driver comprises a first LED driver, the targeted portion of the surface comprises a first targeted portion, the light sensor comprises a first light sensor, the reflected light signal comprises a first reflected light signal, the compensated signal comprises a first compensated signal, and the device further includes a second LED configured to emit light towards a second targeted portion of the surface, a second LED driver to energize the second LED in response to a second compensated signal, a second light sensor configured to measure light reflected from a second targeted portion of the surface and to generate a second reflected light signal representative of one or more properties of the light reflected from the second targeted portion, and a second controller operably coupled with the second LED and second LED driver and configured to generate the second compensated signal based on the second reflected light signal and the input signal. In some versions of these embodiments, the first and second targeted portions at least partially overlap. In various versions, the first controller is configured to act as a master, and the second controller is configured to act as a slave. In various versions, the master is configured to generate the first compensated signal without regard to the first reflected light signal for at least a time interval while the slave controller generates the second compensated signal based on the second reflected light signal and the input signal. In various versions, the master is configured to begin or resume generation of the first compensated signal based on the first reflected light signal and the input signal after the time interval has lapsed.

In various embodiments, in response to a sensed alteration of the first reflected light signal, the first controller is configured to cause the second controller to disregard any alteration of the second reflected light signal for a first time interval, and during the first time interval, generate the first compensated signal based on the altered first reflected light signal and the input signal. In various versions, after the first time interval has lapsed, the first controller is configured to disregard any alteration of the first reflected light signal for a second time interval. In various versions, in response to the sensed alteration of the first reflected light signal, the first controller is configured to drive a bus low during the first time interval and release the bus at the end of the first time interval. In various versions, after the first time interval lapses, the second controller is configured to cause a third controller operably coupled with a third LED and third LED driver to disregard any alteration of a third reflected light signal for a second time interval, and during the second time interval, generate the second compensated signal based at least in part on a sensed alteration of the second reflected light signal.

In various embodiments, the controller is further configured to modulate the compensated signal so that the LED driver energizes the LED to emit coded light carrying information. In various versions, the controller is further configured to distinguish, based on the reflected light signal, between total light reflected from the targeted portion of the surface and coded light carrying the information that is reflected from the surface. In various versions, the controller is configured to generate the compensated signal based on a difference between the total light and the coded light.

In another aspect, the invention relates to a method for controlling a lighting module with an LED driver and an LED that includes: energizing, by the LED driver based on a compensated signal, the LED to emit light towards a targeted portion of a surface; measuring, by a light sensor co-located with the LED, light reflected from the targeted portion of the surface; generating, by the light sensor, a reflected light signal that represents one or more properties of the reflected light; and generating the compensated signal based on the reflected light signal and an input signal that represents one or more desired properties of light to be reflected from the targeted portion of the surface.

In various embodiments, the light emitted towards the targeted portion of the surface and the reflected light measured from the targeted portion have at least partially overlapping optical paths. In various embodiments, the method may further include modulating the compensated signal with information, and energizing, by the LED driver, the LED to emit coded light carrying the information. In various versions, the method may further include distinguishing, based on the reflected light signal, between total light reflected from the targeted portion of the surface and coded light carrying the information that is reflected from the surface. In various versions, generating the compensated signal comprises generating the compensated signal based on a difference between the total light and the coded light.

In various embodiments, the lighting module is a master lighting module, and generating the compensated signal comprises generating the compensated signal without regard to the reflected light signal for at least a time interval while another slave lighting module calibrates light it emits. In various versions, the method further includes beginning or resuming generation of the compensated signal based on the reflected light signal and the input signal after the time interval has lapsed.

In various embodiments, the method further includes causing, in response to a sensed alteration of the reflected light signal, another lighting module to disregard any alteration of reflected light it senses for a first time interval, and during the first time interval, generating the compensated signal based on an altered first reflected light signal and the input signal. In various versions, after the first time interval has lapsed, the method includes disregarding any alteration of the reflected light signal for a second time interval while the another lighting module calibrates light it emits.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above). A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The terms "lighting fixture" and luminaire are used interchangeably herein to refer to an implementation or arrangement of one or more lighting units in a particular form factor, assembly, or package. The terms "lighting unit" and "lighting device" are used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "network" as used herein refers to any interconnection of two or more devices (including controllers or processors) that facilitates the transport of information (e.g., for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Lighting devices/units, luminaires and/or lighting systems may include multiple light sources such as LEDs. When multiple light sources emit light towards a single surface, light emitted by individual light sources may overlap with light emitted by others. This may result in the surface appearing unevenly illuminated, with some portions illuminated more brightly than others. Thus, there is a need in the art to facilitate even distribution of light emitted by a plurality of light sources. More generally, Applicants have recognized and appreciated that it would be beneficial to individually control each light source of a multi-light source luminaire, lighting system and/or lighting device/unit to account for light emitted by other light sources and/or ambient light. In view of the foregoing, various embodiments and implementations of the present invention are directed to controlling light emitted by individual light sources to compensate for light emitted by other light sources and/or ambient light.

Figure 1:
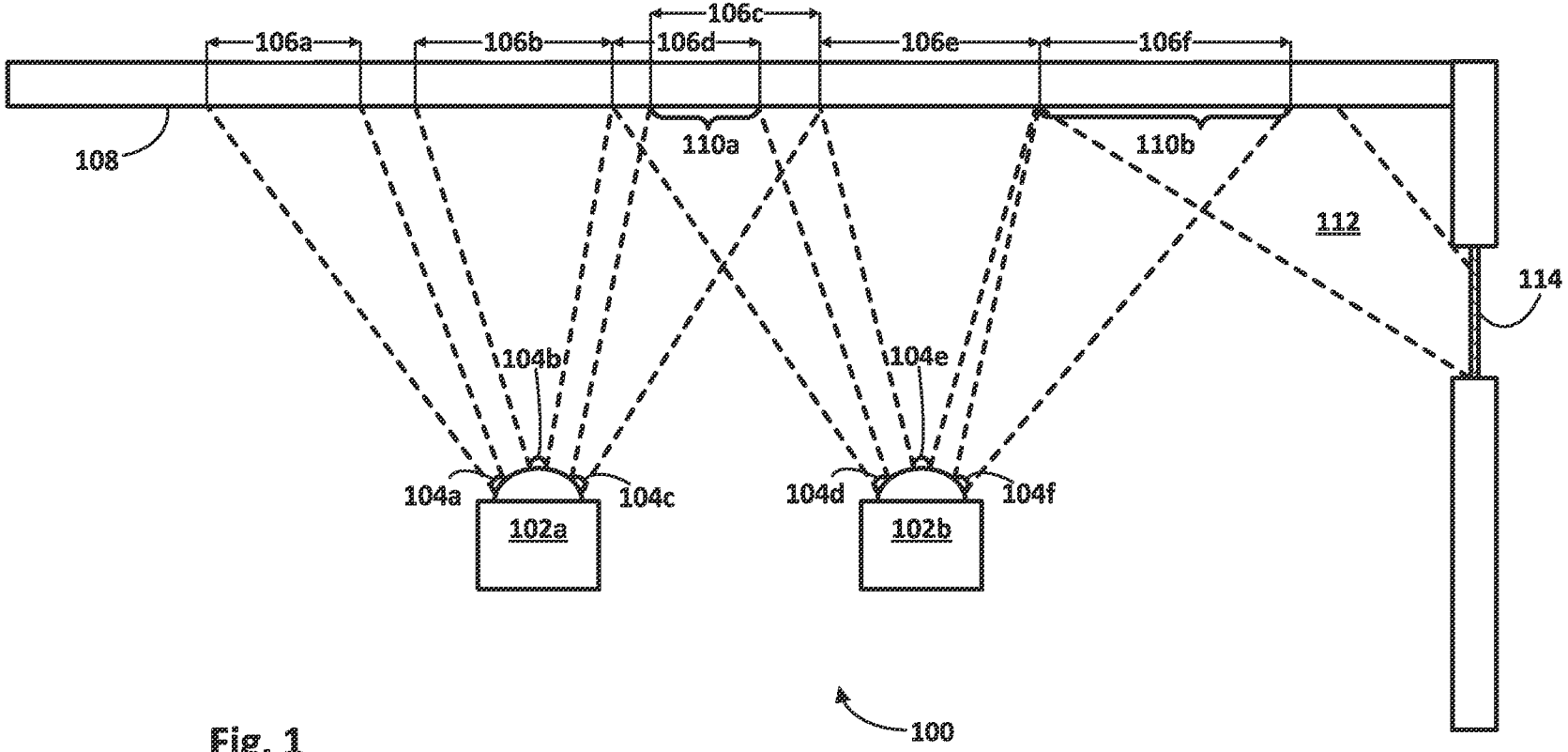
FIG. 1 schematically illustrates an example of lighting devices used to create a collective lighting effect, in accordance with various embodiments.

Referring to FIG. 1, in one embodiment, a first lighting device 102*a* and second lighting device 102*b* (referred to generically as lighting devices 102) may include a plurality of lighting modules 104*a-f* (referred to generically as lighting modules 104). Lighting devices 102 may be luminaires, lighting units, lighting fixtures with lighting units installed, or and any other device with multiple installed and/or integrated lighting modules 104. Lighting modules 104 may include various components that will be described in more detail below.

Plurality of lighting modules 104*a-f* may emit light towards a plurality of targeted portions 106*a-f* of a surface 108. The light reflected off of surface 108 at targeted portions 106 may be alternatively referred to as lighting effects 106. In some instances, lighting effects 106 cast by two different lighting modules 104 may overlap. In FIG. 1, for example, third lighting module 104*c* casts a lighting effect 106*c* that overlaps with a fourth lighting effect 106*d* cast by fourth lighting module 104*d*, creating overlap 110*a*. Where lighting effects 106 overlap, various observable properties of light reflected off surface 108 may be amplified or otherwise altered, such that the observed lighting effect is different from one that is desired. For example, it may be desired that the cumulative lighting effect cast by plurality of lighting modules 104*a-f* onto surface 108 be relatively uniform. In such instances, overlapping lighting effects such as overlap 110*a* may be undesirable. As another example, ambient light conditions may alter over time, e.g., due to time of day, etc. Such changes may also impact observable properties of lighting effects 106. In FIG. 1, for instance, sixth lighting effect 106*f* is affected by ambient light 112 that comes in through a window 114. This creates a second overlap 110*b*, which may be undesirable for reasons similar as first overlap 110*a*.

Accordingly, in various embodiments, lighting modules 106 may be configured with various components to facilitate, at an individual lighting module level, compensation for undesirable artifacts in observed lighting effects, such as overlaps 110*a* and 110*b*. For example, each lighting module 106 may be configured to emit light towards, and measure light reflected from, a targeted portion 106 of surface 108, and alter the light it emits to calibrate one or more lighting properties of its respective lighting effect 106 to correspond with one or more desired lighting properties. This may be used, for instance, to smooth out a collective lighting effect created by a plurality of lighting modules 104.

Figure 2:
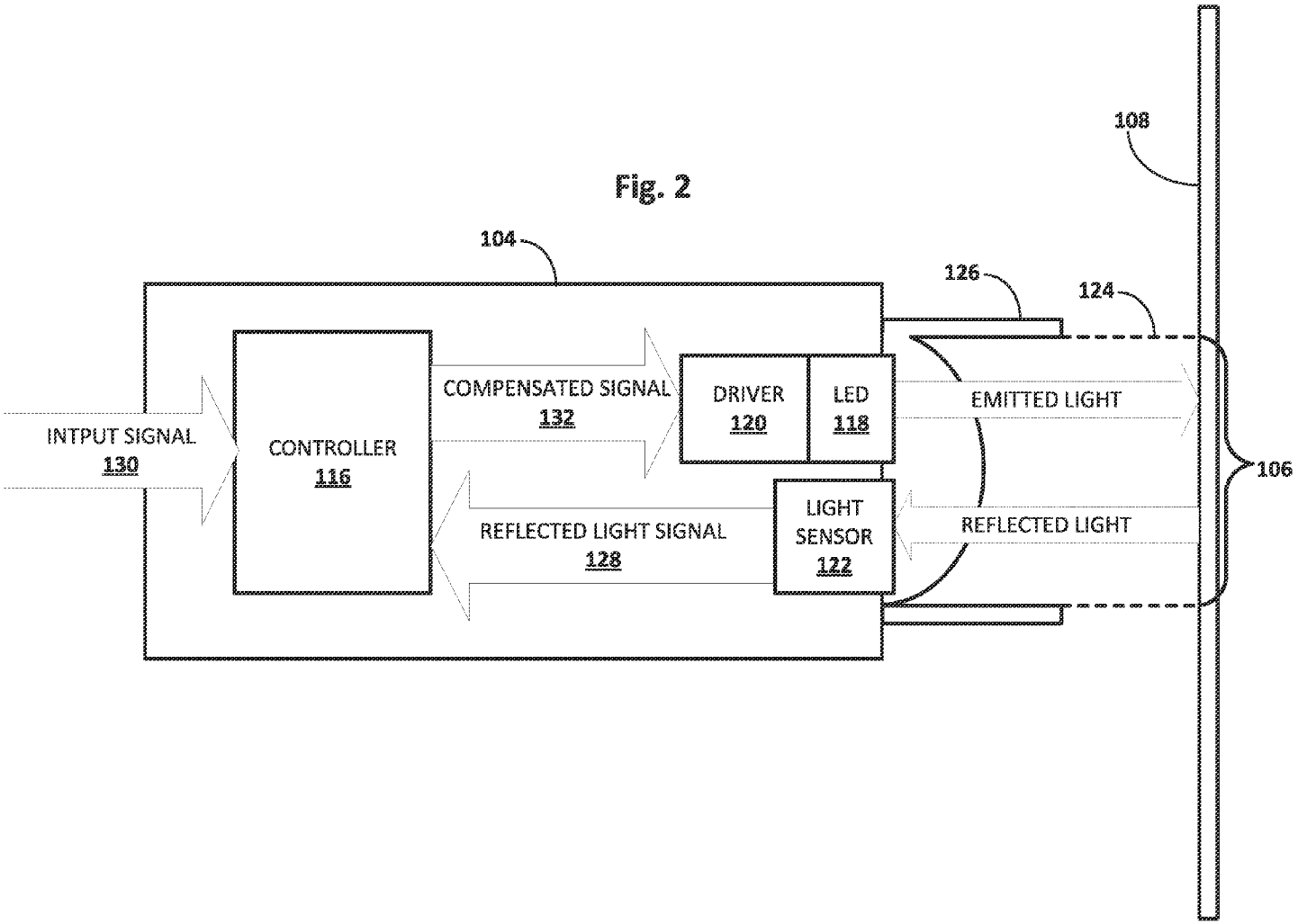
FIG. 2 schematically illustrates an example lighting module configured with selected aspects of the present disclosure, in accordance with various embodiments.

Components of an example lighting module 104 are depicted in FIG. 2. Lighting module 104 may include a controller 116. Controller 116 may be operably coupled with one or more light sources, such as an LED 118 via a corresponding LED driver 120. Controller 116 may also be operably coupled with a light sensor 122. In various embodiments, light sensor 122 may come in various forms, such as a photo diode, a photo transistor, a light-dependent resistor (LDR), an additional LED, and so forth.

In various embodiments, light sensor 122 may be configured to sense light reflected from a targeted portion 106 of surface 108. In some embodiments, such as that shown in FIG. 2, light sensor 122 may be co-located with LED 118 such that light observed by light sensor 122 at least partially overlaps a same optical path 124 as light emitted by LED 118. In some embodiments, optical path 124 may be defined at least in part with one or more optical elements 126. Optical elements 126 may come in various forms, such as lenses, collimators, and so forth. Based on sensed light reflected off targeted portion 106 of surface 108, light sensor 122 may generate a reflected light signal 128.

In various embodiments, controller 116 may receive an input signal 130. Input signal 130 may represent one or more desired properties of light (e.g., brightness, intensity, coded light signal, hue, saturation, color temperature, etc.) to be reflected from targeted portion 106 of surface 108. For instance, input signal 130 may be a signal from a lighting system bridge (not depicted) that is configured to cause controller 116 to provide another signal to LED driver 120 that causes LED driver 120 to drive LED 118 (e.g., using pulse width modulation or a selected current) to emit light having one or more desired properties. Or, input signal 130 may come from a dimming wall switch or another adjustable input source such as a computing device (e.g., smart phone, laptop, tablet, wearable smart glasses or watches, etc.). In various embodiments, input signal 130 may be the same for multiple lighting modules 104 of a lighting device 102, e.g., so that those multiple lighting modules 104 may collectively create a uniform lighting effect on a surface. However, this is not required. In other embodiments, separate lighting modules 104 of a lighting device 102 may receive different input signals 130.

In order to calibrate light emitted by LED 118 so that reflected light measured by light sensor 122 corresponds with desired light represented by input signal 130, in various embodiments, controller 116 may generate and provide to LED driver 120 a compensated signal 132. Controller 116 may generate compensated signal 132 based on input signal 130 and reflected signal 128. For instance, controller 116 may compare input signal 130 with reflected light signal 128, and may alter compensated signal 132 to compensate for differences. In this manner, lighting module 104 may account for differences between expected and actual properties of the lighting effect 106 it creates, e.g., to emit less intense light so that a region of overlap between two lighting effects (e.g., 110*a* in FIG. 1) is "blended" into a collective lighting effect.

In various embodiments, one lighting module 104 of a plurality of lighting modules 104 forming part of a lighting device 102 may act as a master, and others of the plurality of lighting modules 104 may act as slaves. Master and slave lighting modules may be configured to react differently to changes in reflected light sensed by their respective light sensors 122. For example, a controller 116 of a lighting module 104 acting as a master may react or not react to an alteration in its reflected light signal 128 in one way, and another controller 116 of another lighting module 104 acting as a slave may react or not react to its own reflected light signal 128 in a different way.

For example, in some embodiments, a controller 116 of a lighting module 104 acting as a master may be configured to generate its own compensated signal 132 without regard to reflected light signal 128 for at least a predetermined time interval. Meanwhile, another controller 116 of another lighting module 104 acting as a slave may, during the predetermined time interval, generate its own compensated signal 132 based on its own reflected light signal 128 and the input signal 130. Once the time interval lapses, slave lighting module 104 (and perhaps other slave lighting modules on the light device) may have had time to calibrate its own light output. In such case, it may no longer be necessary to calibrate the light output of the master lighting module 104, or the master lighting module 104 may calibrate its light output in a manner selected to avoid changing lighting properties sensed by the slave lighting module 104. At any rate, once the time interval lapses, in various embodiments, the master may resume generation of its own compensated signal 132 based on its own reflected light signal 128 and input signal 130.

Figure 3:
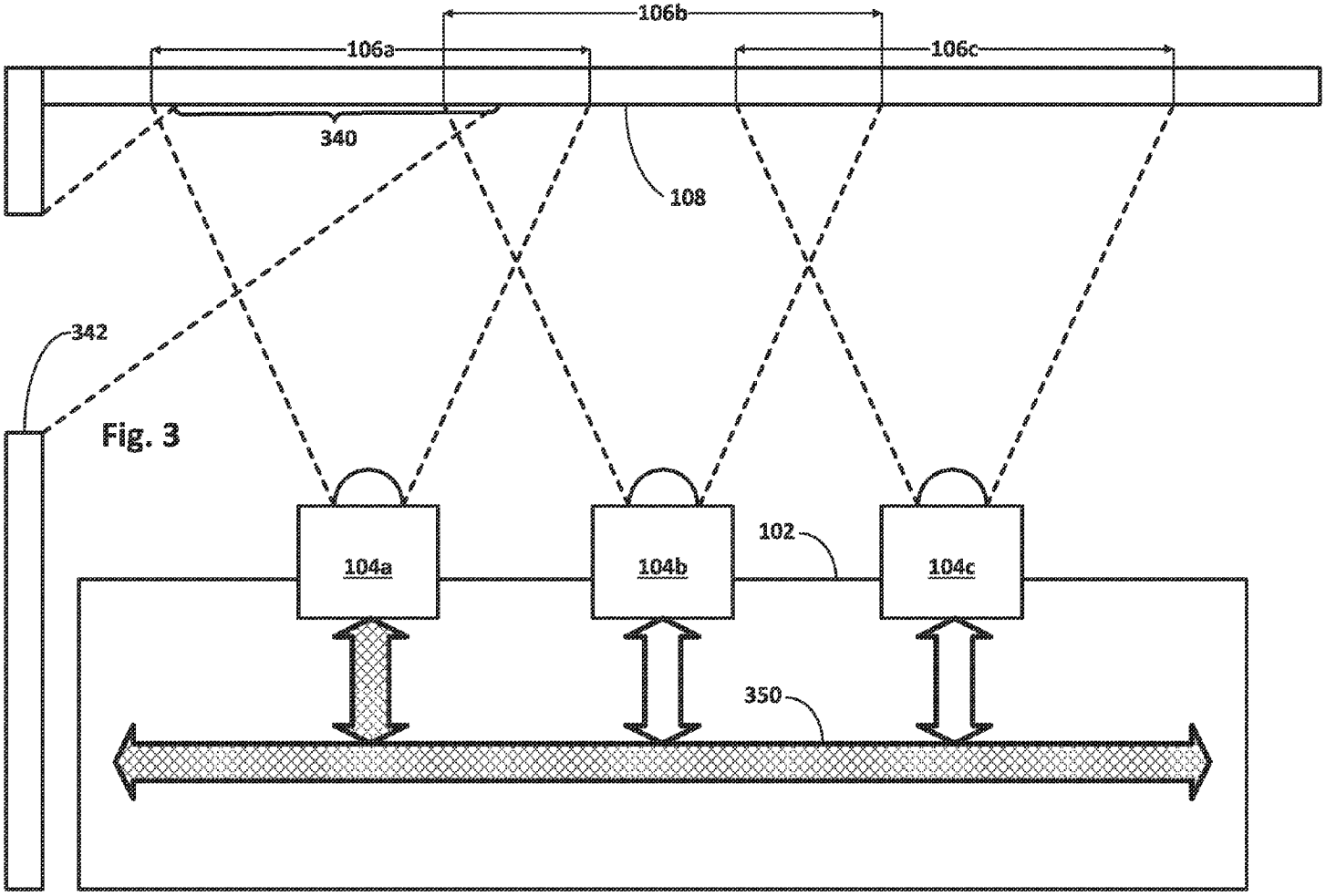
FIG. 3 schematically illustrates an example of how lighting modules configured with selected aspects of the present disclosure may cooperate to compensate for the intrusion of ambient light, in accordance with various embodiments.

In other embodiments, master and slave lighting modules 104 may cooperate in different ways. For instance, and referring to FIG. 3, assume first lighting module 104*a* has sensed, e.g., through its respective light sensor 122 (not depicted in FIG. 3, see FIG. 2 for an example), an alteration of its reflected light signal. For instance, assume ambient light 340 is leaking in through a window 342 and is moving gradually across the collective lighting effect 106*a-c* created by lighting modules 104*a-c* as the sun moves across the sky.

First lighting module 104*a* may respond to ambient light 340 by causing other lighting modules 104 to disregard any alteration of their own reflected light signals for a predetermined time interval. During that predetermined time interval, first lighting module 104*a* may generate (e.g., by way of a controller, not depicted in FIG. 3, see FIG. 2) its own compensated signal based on its own, reflected light signal (which may be altered due to the intrusion of ambient light 340) and input signal 130. After the predetermined time interval has lapsed, first lighting module 104*a* may disregard any further alteration of its reflected light signal for another predetermined time interval while second lighting module 104*b*, third lighting module 104*c*, and/or any other lighting modules associated with lighting device 102 have a chance to calibrate their own emitted light output to compensate for intrusion of ambient light 340.

For example, in some embodiments, in response to sensed alteration of its reflected light signal, first lighting module 104*a* may drive a bus 350 low (as indicated by the shading) during the first predetermined time interval. While the bus 350 is low, other lighting modules such as 104*b* and 104*c* may disregard (e.g., be decoupled from) their own reflected light signals. First lighting module 104*a* may release the bus 350 at the end of the first predetermined time interval. After that, second lighting module 104*b* or another lighting module may drive the bus 350 low to effectively exclude other lighting modules from calibrating their lighting output, and may calibrate its own light output to compensate for the intervening light. Once second lighting module 104*b* has completed its own calibration, it may release the bus 350, and calibration may continue with other lighting modules 104 of lighting device 102.

Lighting modules 104 configured with selected aspects of the present disclosure may utilize other techniques to cooperatively calibrate their light outputs to compensate for overlapping lighting effects and/or intervening sources of light (e.g., sunlight). Referring back to FIG. 2, in some embodiments, controller 116 may modulate compensated signal 132 so that LED driver 120 energizes LED 118 to emit coded light carrying information. That way, controller 116 may be able to distinguish, based on reflected light signal 128, between total light reflected from targeted portion 106 of surface 108 (which could include ambient light and/or light from other lighting modules) and coded light carrying the information which corresponds to light emitted by LED 118. Controller 116 may then generate compensated signal 132 based on a difference between the total light and the coded light, rather than simply based on total light.

Figure 4:
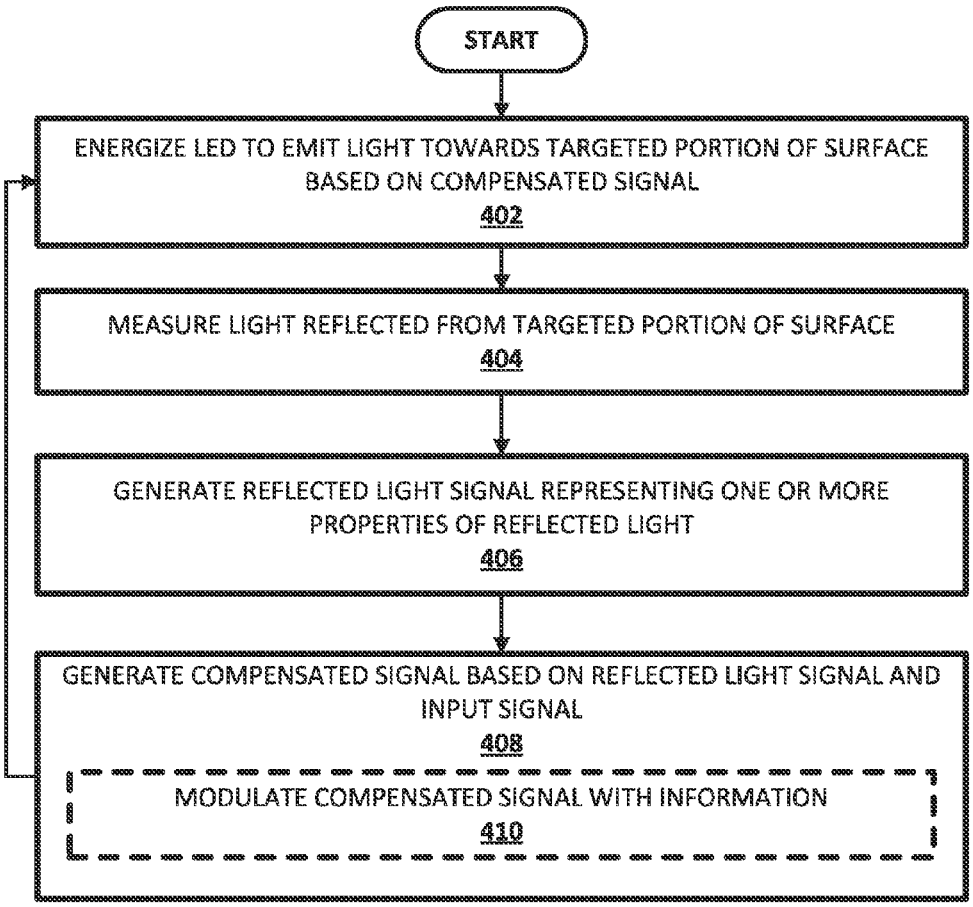
FIG. 4 depicts an example method of operating a lighting module configured with selected aspects of the present disclosure, in accordance with various embodiments.

FIG. 4 depicts an example method 400 for controlling a lighting module 104, in accordance with various embodiments. While the operations are shown in a particular order, this is not meant to be limiting. One or more operations may be reordered, added and/or omitted. At block 402, LED 118 may be energized, e.g., by LED driver 120, to emit light towards targeted portion 106 of surface 108, e.g., based on compensated signal 132.

At block 404, light reflected from targeted portion 106 of surface 108 may be measured, e.g., by light sensor 122. At block 406, reflected light signal 128 representing one or more properties of light sensed in the reflected light may be generated, e.g., by light sensor 122. At block 408, compensated signal 132 may be generated, e.g., by controller 116, based on reflected light signal 128 and input signal 130. In some embodiments, at optional block 410, compensated signal 132 may be modulated, e.g., by controller 116, to include information. That way, at block 402, LED 118 may be energized, e.g., by LED driver 120, to emit a coded light signal carrying the information.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

It should also be understood that, unless clearly indicated to the contrary, in any methods claimed herein that include more than one step or act, the order of the steps or acts of the method is not necessarily limited to the order in which the steps or acts of the method are recited.

Reference numerals appearing the claims between parentheses, if any, are provided merely for convenience and should not be construed as limiting the claims in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A method for controlling a lighting module with a plurality of LED drivers and a plurality of LEDs, comprising:

energizing, by each LED driver based on a compensated signal, each LED to emit light towards a targeted portion of a surface;

measuring, by a light sensor co-located with each LED, light reflected from the targeted portion of the surface;

generating, by each light sensor, a reflected light signal that represents one or more properties of the reflected light; and generating the compensated signals based on the reflected light signal and an input signal that represents one or more desired properties of light to be reflected from the targeted portion of the surface, wherein the compensated signal is configured to evenly distribute light emitted by the plurality of LEDs to the targeted portions of the surface, wherein the lighting module is a master lighting module, and wherein generating the compensated signal comprises generating the compensated signal without regard to the reflected light signal for a predetermined time interval while another slave lighting module calibrates light it emits.

2. The method of claim 1, wherein the light emitted towards the targeted portions of the surface and the reflected light measured from the targeted portions have at least partially overlapping optical paths.

3. The method of claim 1, further comprising:

modulating the compensated signal with information; and energizing, by the LED driver, the LED to emit coded light carrying the information.

4. The method of claim 3, further comprising distinguishing, based on the reflected light signal, between total light reflected from the targeted portion of the surface and coded light carrying the information that is reflected from the surface.

5. The method of claim 4, wherein generating the compensated signal comprises generating the compensated signal based on a difference between the total light and the coded light.

6. The method of claim 1, further comprising beginning or resuming generation of the compensated signal based on the reflected light signal and the input signal after the time interval has lapsed.

7. The method of claim 1, further comprising:

causing, in response to a sensed alteration of the reflected light signal, another lighting module to disregard any alteration of reflected light it senses for a first time interval; and during the first time interval, generating the compensated signal based on an altered first reflected light signal and the input signal.

8. The method of claim 7, wherein after the first time interval has lapsed, disregarding any alteration of the reflected light signal for a second time interval while the another lighting module calibrates light it emits.

* * * * *